US008890431B2

(12) United States Patent
Lee et al.

(10) Patent No.: US 8,890,431 B2
(45) Date of Patent: Nov. 18, 2014

(54) LED DRIVING APPARATUS AND METHOD

(75) Inventors: Change Seok Lee, Seoul (KR); Yeun Joong Lee, Seoul (KR); Deuk Hee Park, Gyunggi-do (KR); Sang Hyun Cha, Seoul (KR); Jae Shin Lee, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 499 days.

(21) Appl. No.: 13/220,041

(22) Filed: Aug. 29, 2011

(65) Prior Publication Data

US 2012/0306396 A1 Dec. 6, 2012

(30) Foreign Application Priority Data

May 30, 2011 (KR) ..... 10-2011-0051352

(51) Int. Cl.
*H05B 37/02* (2006.01)
*H05B 33/08* (2006.01)

(52) U.S. Cl.
CPC ..... *H05B 33/0815* (2013.01)
USPC ..... 315/291; 315/307

(58) Field of Classification Search
USPC ..... 315/209 R, 224–226, 291, 307, 308, 312
See application file for complete search history.

(56) References Cited

U.S. PATENT DOCUMENTS

2010/0213857 A1* 8/2010 Fan ..... 315/186
2011/0057576 A1* 3/2011 Otake et al. ..... 315/291

FOREIGN PATENT DOCUMENTS

JP 2010-287340 12/2010

* cited by examiner

*Primary Examiner* — Jimmy Vu
(74) *Attorney, Agent, or Firm* — McDermott Will & Emery LLP

(57) ABSTRACT

There are provided an LED driving apparatus and an LED driving method thereof. The LED driving apparatus includes: a light emitting unit including one or more LEDs, a rectifying unit rectifying an input signal to generate a first signal; a signal conversion unit inverting a waveform of a first signal to generate a second signal; and an operation unit arithmetically operating the first and second signals. A plurality of AC signals each having a different waveform are arithmetically operated to generate a signal having a small amount of a ripple component, and an LED is driven by the signal, thus preventing a lifespan of the LED from being shortened by omitting a smoothing electrolytic capacitor, one of main causes shortening the lifespan of an LED driving circuit.

9 Claims, 4 Drawing Sheets

LED DRIVING APPARATUS AND METHOD

CROSS-REFERENCE TO RELATED APPLICATIONS

This application claims the priority of Korean Patent Application No. 10-2011-0051352 filed on May 30, 2011, in the Korean Intellectual Property Office, the disclosure of which is incorporated herein by reference.

BACKGROUND OF THE INVENTION

1. Field of the Invention

The present invention relates to alight emitting diode (LED) driving apparatus capable of preventing a lifespan of an LED from being shortened, and an LED driving method thereof.

2. Description of the Related Art

An LED is a semiconductor device which is formed to have a p-n junction structure and emits light according to electron hole recombination and is applied in various fields in line with recent advancements in semiconductor technology. In particular, since an LED has high efficiency and a long lifespan and is environmentally friendly, compared with existing light emitting devices, it may be applied to many fields In general, in terms of its structure, an LED can be driven by applying DC power of a few volts thereto, and thus, in general, in order to drive an LED with commercial AC power used in households, offices, or the like, a specific unit of transforming power is required. In order to drive an LED with commercial AC power, an LED driving apparatus typically includes a rectifying circuit, an AC-DC converter, or the like.

However, a general AC-DC converter is voluminous and consumes a great amount of power, so the application of the general AC-DC converter to the LED driving apparatus severely counteracts the advantages of the LED such as high efficiency, small package size, long life span, and the like. Also, a capacitor connected to an output terminal in order to remove a ripple component included in an input signal converted from AC to DC to drive the LED, shortens the lifespan of the LED.

SUMMARY OF THE INVENTION

An aspect of the present invention provides an LED driving apparatus capable of stably driving an LED and preventing a lifespan of the LED from being shortened, and an LED driving method thereof.

According to an aspect of the present invention, there is provided an LED driving apparatus including: a rectifying unit rectifying an input signal to generate a first signal; a signal conversion unit inverting the first signal to generate a second signal; and an operation unit arithmetically operating the first and second signals to generate a driving signal.

The LED driving apparatus may further include: a signal level control unit controlling the level of the first signal and transferring the controlled first signal to at least one of the signal conversion unit and the operation unit.

The signal level control unit may include a transformer controlling the level of the first signal.

The LED driving apparatus may further include: a smoothing circuit unit removing a ripple component included in the driving signal.

The smoothing circuit unit may include a multi-layer ceramic capacitor (MLCC).

The signal conversion unit may invert the first signal on the basis of an intermediate value of the first signal corresponding to half of a level peak value of the first signal to generate the second signal.

According to another aspect of the present invention, there is provided a method of driving an LED, including: rectifying an input signal to generate a first signal; inverting the first signal to generate a second signal; and arithmetically operating the first and second signals to generate a driving signal.

The generating of the driving signal may include adding the first and second signals to generate a smoothed DC signal.

The method may further include applying the driving signal to one or more LEDs.

The method may further include removing a ripple component from the driving signal.

In the generating of the second signal, the second signal may be generated by inverting the first signal on the basis of an intermediate value of the first signal corresponding to half of a level peak value of the first signal.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
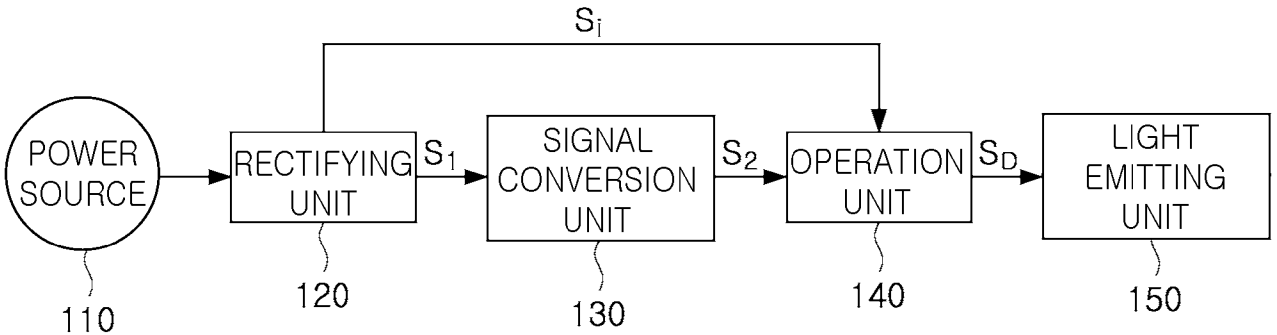
FIG. 1 is a block diagram of an LED driving apparatus according to an embodiment of the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Hereinafter, embodiments will be described in detail with reference to the accompanying drawings such that they could be easily practiced by those skilled in the art to which the present invention pertains.

FIG. 1 is a block diagram of an LED driving apparatus according to an embodiment of the present invention.

Referring to FIG. 1, an LED driving apparatus 100 may include a rectifying unit 120 rectifying an input signal supplied from a power source 110, a signal conversion unit 130 converting a first signal $S_1$ output from the rectifying unit 120 to generate a second signal $S_2$, and an operation unit 140 arithmetically operating the first signal $S_1$ output from the rectifying unit 120 and the second signal $S_2$ output from the signal conversion unit 130. A light emitting unit 150 including one or more LEDs may be connected to an output terminal of the operation unit 140. Here, the input signal supplied from the power source 110 to the rectifying unit 120 may be commercial power (e.g., AC power of 220V/60 Hz).

The rectifying unit 120 may rectify the input signal supplied from the power 110 through an input terminal to generate the first signal $S_1$, and may output the first signal $S_1$. For example, the rectifying unit 120 may include a diode bridge circuit including four diodes in order to full-wave rectify an AC signal supplied from the power source 110, and a signal level control unit (not shown) for selectively controlling the level of the first signal $S_1$ may be provided with an output terminal of the rectifying unit 120.

When the power source 110 supplies a general AC signal such as commercial power (220V/60 Hz), the rectifying unit 120 converts the AC signal whose direction is changed to the opposite direction at every half period of commercial power into the first signal $S_1$ which flows in one direction, through full-wave rectification. Through this process, the rectifying unit 120 may generate a rectified signal having a doubled frequency as compared with the output signal of the power source 110.

When a signal level control unit is selectively included between the rectifying unit 120 and the signal conversion unit 130, the signal level control unit can adjust the level of the first signal $S_1$ such that the first signal $S_1$ output from the rectifying unit 120 may not have an excessive level of voltage or current. For example, the signal level control unit may be implemented as a transformer or may be implemented as one or more resistors and transistors, or the like.

The signal conversion unit 130 may convert the first signal $S_1$ which has been rectified by the rectifying unit 120 to generate the second signal $S_2$. For example, the signal conversion unit 130 may invert the first signal $S_1$ on the basis of an intermediate value of a first signal $S_1$ level corresponding to half of a peak value of the first signal $S_1$ level to generate the second signal $S_2$.

The signal conversion unit 130 may include an active element such as an operational amplifier (op-amp), a capacitor having a small capacity, and the like. The capacitor included in the signal conversion unit 130 has a relatively very small capacity as compared with that of an electrolytic capacitor used for signal smoothing in a general LED driving apparatus, so it does not greatly affect a shortening of the lifespan of the LED.

The operation unit 140 arithmetically operates the second signal $S_2$ output from the signal conversion unit 130 and the first signal $S_1$ output from the rectifying unit 120 to generate a driving signal $S_D$ for operating the light emitting unit 150. When the power source 110 outputs an AC signal such as the commercial power 220V/60 Hz, the rectifying unit 120 may output a rectified signal flowing in one direction, unlike a general AC signal, as a first signal $S_1$, and the signal conversion unit 130 converts a waveform of the first signal $S_1$ to output the second signal $S_2$ having the same phase as that of the first signal $S_1$ and having an upside down (inverted) waveform based on a certain signal level value. For example, the operation unit 140 adds the first signal $S_1$ and the second signal $S_2$ to generate the driving signal $S_D$ having a certain value such as that of a DC signal, and applies the driving signal $S_D$ to the light emitting unit 150, thereby controlling the operation of the LED without a specific ADC and a capacitor having a large capacity for signal smoothing.

Figure 2:
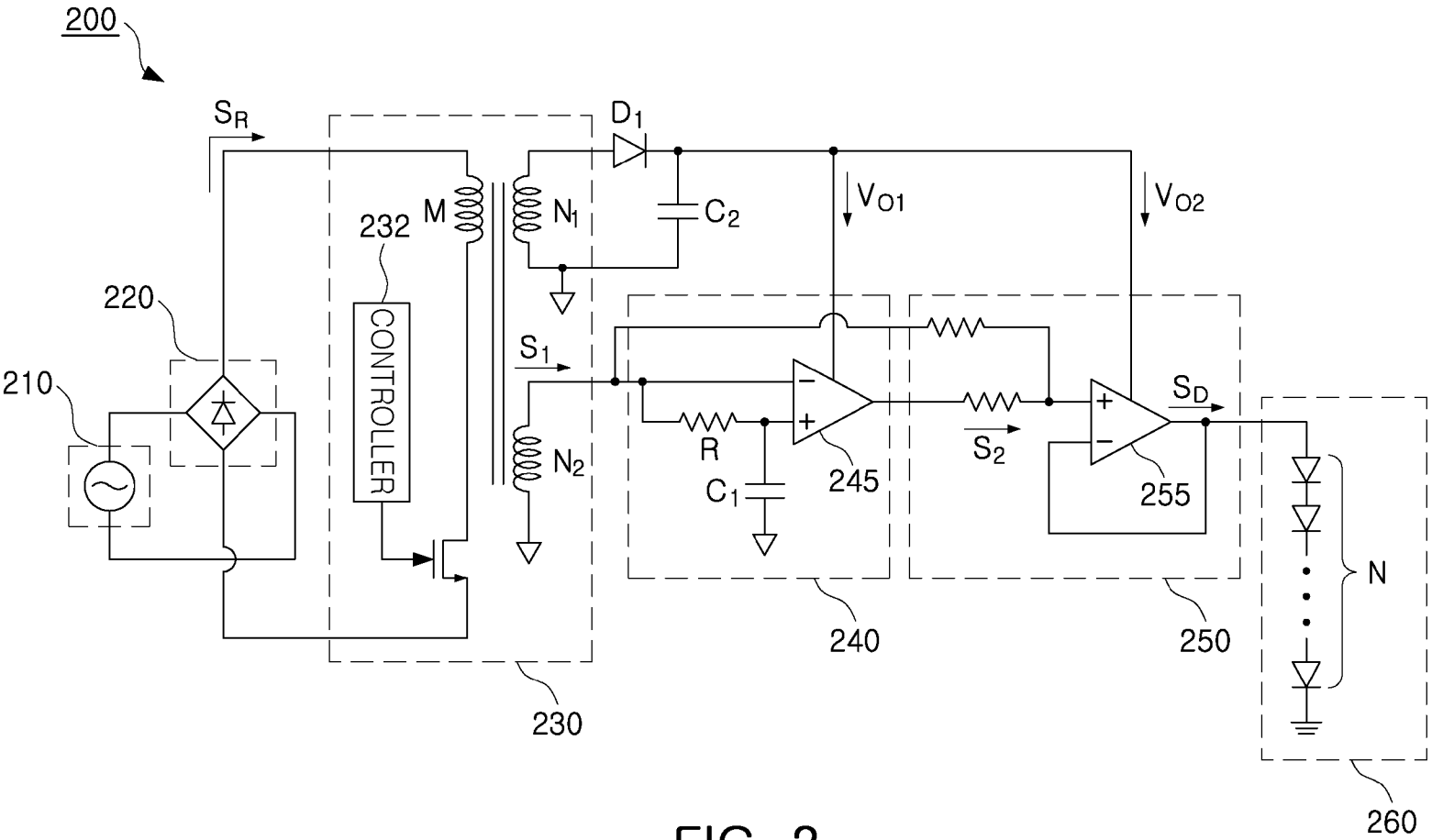
FIG. 2 is a circuit diagram of the LED driving apparatus according to an embodiment of the present invention.

FIG. 2 is a circuit diagram of the LED driving apparatus according to an embodiment of the present invention.

Referring to FIG. 2, the LED driving apparatus 200 according to an embodiment of the present invention may include a power source 210, a rectifying unit 220, a signal level control unit 230, a signal conversion unit 240, and an operation unit 250. Like the case of FIG. 1, a light emitting unit 260 including one or more LEDs may be connected to an output terminal of the operation unit 250.

As described above with reference to FIG. 1, the power source 210 may be a commercial power source supplying general commercial AC power, and the rectifying unit 220 may include a diode bridge for full-wave rectifying an input signal $S_i$ output from the power source 210 to generate a rectified signal $S_R$. In the present embodiment, it is assumed that the signal level control unit 230 is included and implemented as a transformer for controlling the level of the rectified signal $S_R$ output by the rectifying unit 220 after the rectifying unit 220 rectifies the input signal supplied from the power source 210, but the signal level control unit 230 may be excluded or may be implemented by any electrical element other than the transformer.

The first signal $S_1$ output by the rectifying unit 220 is input to an input winding M of the signal level control unit 230, and a plurality of output windings $N_1$ and $N_2$ are disposed at a secondary side of the transformer of the signal level control unit 230. The first output winding $N_1$ may be set to have an appropriate winding ratio ($M:N_1$) with the input winding M, and an electrical signal induced to the first output winding $N_1$ charges electric charges in a capacitor $C_2$ through a diode $D_1$. The electric charges charged in the capacitor $C_2$ may be used to apply voltages $V_{O1}$ and $V_{O2}$ required for operating active elements 245 and 255 included in the signal conversion unit 240 and the operation unit 250.

An electrical signal induced to the second output winding $N_2$ by the rectified signal $S_R$ applied to the input winding M is input as the first signal $S_1$ to the signal conversion unit 240 and the operation unit 250. The signal conversion unit 240 may include passive elements R and $C_1$ and an active element (i.e., operational amplifier) 245, and as described above, a driving voltage of the active element 245 may be provided from the capacitor $C_2$ connected to the first output winding $N_1$.

Hereinafter, the process of generating the driving signal $S_D$ applied to the light emitting unit 260 through the signal level control unit 230, the signal conversion unit 240, and the operation unit 250 will now be described with reference to FIG. 3.

Figure 3:
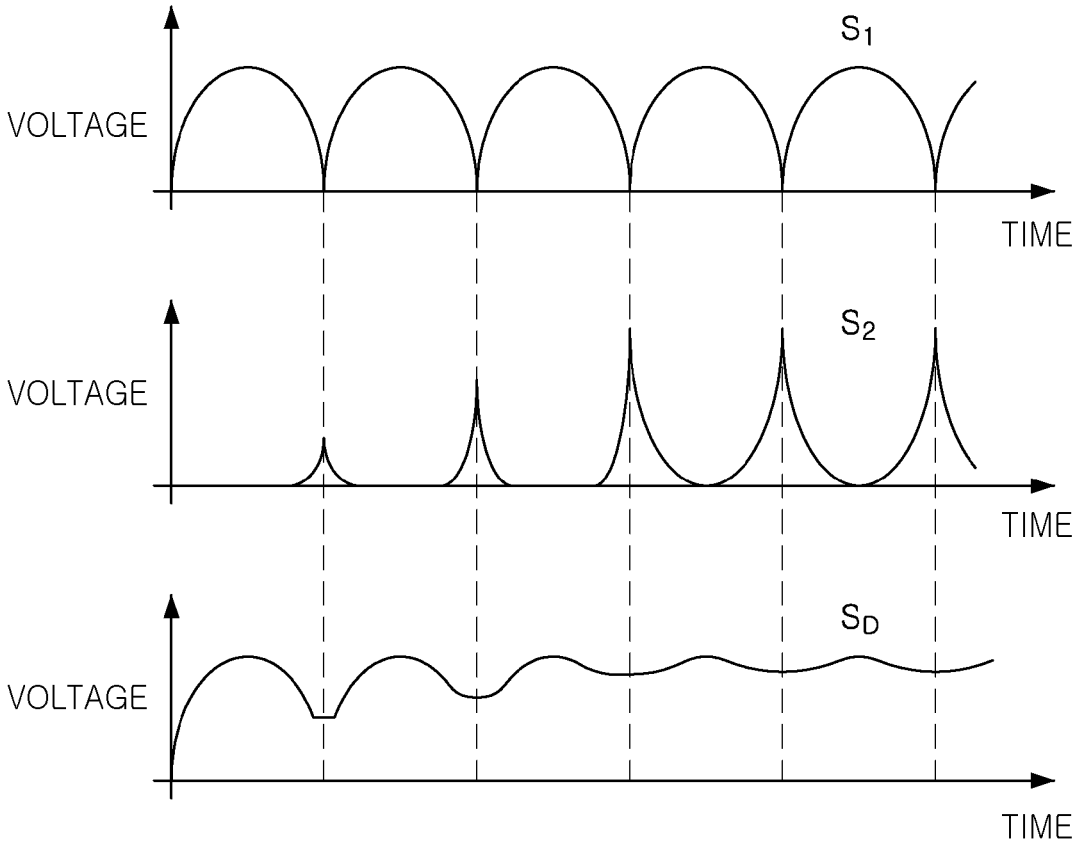
FIG. 3 is a view showing waveforms provided to explain the operation of the LED driving apparatus according to an embodiment of the present invention.

FIG. 3 is a view showing signal waveforms provided to explain the operation of the LED driving apparatus according to an embodiment of the present invention.

The first signal $S_1$ induced to the second output winding $N_2$ appears in the form of a first waveform shown in FIG. 3, and is input to the signal conversion unit 240 and the operation unit 250, respectively. The transformer included in the signal level control unit 230 simply controls the level of the rectified signal $S_R$ to prevent excessive voltage or current from being applied to the light emitting unit 260, without affecting the phase or frequency of the rectified signal $S_R$.

As shown in FIG. 2, the first signal $S_1$ induced to the second output winding $N_2$ is input, as an input signal of the signal conversion unit 240, to an inversion terminal of the active element 245, and a signal, which has passed through a circuit unit including the resistor R and the capacitor $C_1$ connected in series, is input to a non-inversion terminal of the active element 245. Since voltage according to electric charges charged in the capacitor $C_1$ is applied to the non-inversion terminal of the active element 245 and the first signal $S_1$ is applied to the capacitor $C_1$ through the resistor R, when an unstable initial state has gone, the voltage of the capacitor $C_1$ is stabilized at the same level as the peak value of the first signal $S_1$.

The second signal $S_2$ output by the active element 245 is expressed by a value obtained by multiplying the difference between the voltage of the capacitor $C_1$ input to the non-inversion terminal and the first signal $S_1$ input to the inversion terminal by the gain of the active element 245. Thus, a signal obtained by subtracting the first signal $S_1$ from the voltage of the capacitor $C_1$ having the same level as the peak value of the first signal $S_1$ is output as the second signal $S_2$ through the output terminal of the active element 245. Through the foregoing process, the second signal $S_2$ in the form of inverting the first signal $S_1$ on the basis of an intermediate value of the first signal $S_1$ level corresponding to half of the peak value of the first signal $S_1$ level is generated.

Namely, the waveform of the second signal $S_2$ output from the signal conversion unit 240 through the active element 245 appears in a form in which the waveform of the first signal $S_1$ is inverted, like a second waveform shown in FIG. 3. In this case, the gain of the active element 245 can be determined such that a voltage or current level applied to the LEDs 260-1, 2, . . . , N included in the light emitting unit 260 is not excessive.

The operation unit 250 may include at least one active element 255 as shown in FIG. 2, and in the present embodiment, it is assumed that an operational amplifier is used as the active element 255. The first signal $S_1$ induced to the second output winding $N_1$ and the second signal $S_2$, an output signal of the signal conversion unit 240, are applied to a non-inversion input terminal of the active element 255. Resistance between input terminals of the operational amplifier used as the active element 255 is very strong (which is infinite in an ideal case), so the first signal $S_1$, induced to the second output winding $N_2$ of the signal level control unit 230 at the non-inversion input terminal of the active element 255 and the second signal $S_2$, an output from the signal conversion unit 240, are added.

The sum of the first signal $S_1$ and the second signal $S_2$ is input to the non-inversion terminal of a voltage follower implemented as the active element 255 and transferred to an output terminal of the active element 255. Accordingly, the driving signal $S_D$ input to the light emitting unit 260 through the output terminal of the active element 255 appears in the form of a third waveform in FIG. 3.

As shown in the third waveform in FIG. 3, when the driving signal $S_D$ applied to the light emitting unit 260 enters a steady state after a settling time in an early driving stage has passed, it includes only a ripple component having a very small size. Thus, such a smoothing electrolytic capacitor, which is connected to an output terminal of the driving signal in order to remove the ripple component included in the LED driving signal, as in the related art LED driving apparatus is not necessary, or it can be substituted by a multi-layer ceramic capacitor (MLCC) having a very small capacity, so the reduction in the lifespan of the LED, a side effect caused by the electrolytic capacitor having a large capacity, can be prevented.

Figure 4:
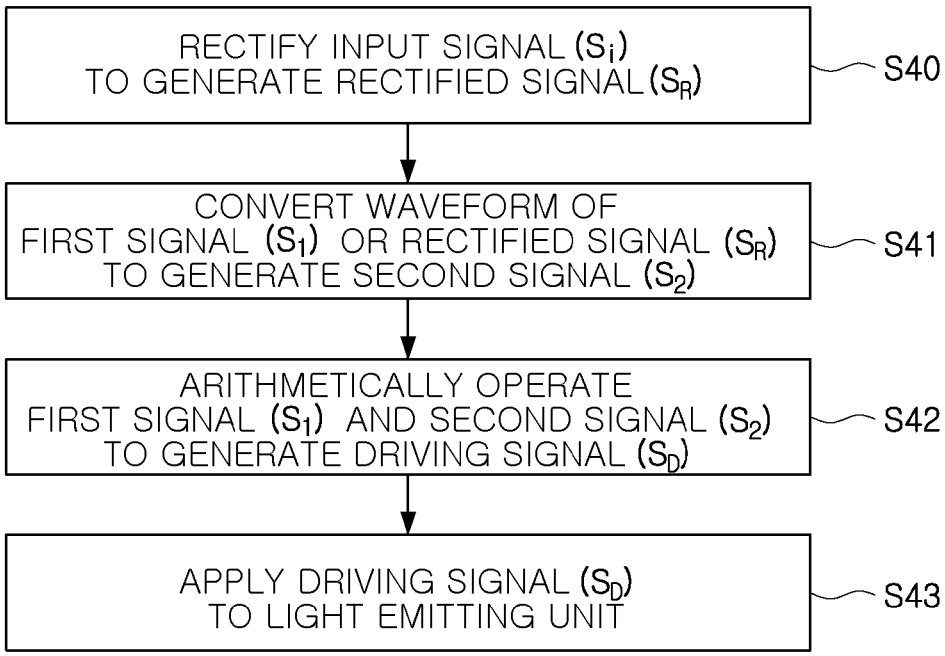
FIG. 4 is a flow chart illustrating a process of a method for driving an LED according to an embodiment of the present invention.

FIG. 4 is a flow chart illustrating a process of an operation method of the LED driving apparatus according to an embodiment of the present invention.

Referring to FIG. 4, the method of driving an LED according to an embodiment of the present invention starts from rectifying an input signal $S_i$ to generate a rectified signal $S_R$ (S40). As described above, the input signal $S_i$ may be an AC signal (220V/60 Hz) output by a commercial power source, and here, since the input signal $S_i$ is full-wave rectified to generate the rectified signal $S_R$, a driving signal $S_D$ for driving the light emitting unit 260 at every time slot can be generated without causing a loss of the input signal $S_i$. The rectifying unit 220 may include a diode rectifier implemented by a plurality of diodes for full-wave rectification.

The signal conversion unit 240 converts the first signal $S_1$ or the rectified signal $S_R$ to generate a second signal $S_2$ (S41). When the signal level control unit 230 which can be selectively included in the LED driving apparatus according to an embodiment of the present invention is provided, the signal conversion unit 240 converts the first signal $S_1$ generated by controlling the level of the rectified signal $S_R$ to generate the second signal $S_2$. Meanwhile, when the signal level control unit 230 is not provided, since the first signal $S_1$ and the rectified signal $S_R$ are the same, the rectified signal $S_R$ is directly converted, without performing an additional level control, to generate the second signal $S_2$. As afore-mentioned, the signal conversion unit 240 can generate the second signal $S_2$ which has the same phase as that of the first signal $S_1$ and is in the form in which the waveform of the first signal $S_1$ is inverted upside down. The second signal $S_2$ is input to the operation unit 250.

The operation unit 250 arithmetically operates the first signal $S_1$ and the second signal $S_2$ output from the signal conversion unit 240 (S42). The operation unit 250 may add the second signal $S_2$, which has been obtained by inverting the first signal $S_1$, to the first signal $S_1$, thereby converting an AC type signal having a particular frequency into a DC type driving signal $S_D$ for operating the light emitting unit 260. Through such a configuration, the LED driving apparatus can be implemented without an AC-DC converter (ADC).

In case in which the commercial AC signal is intended to be utilized as the input signal Si to drive the LED, if the LED driving apparatus according to an embodiment of the present invention is implemented without the signal level control unit 230, the LEDs included in the light emitting unit 260 would be possibly damaged and the lifespan of the LEDs would be possibly shortened due to an excessive voltage level of the driving signal $S_D$ applied to the light emitting unit 260. Thus, the signal level control unit 230 may be disposed between the rectifying unit 220 and the phase controlling unit 240 to adjust the level of the rectified signal $S_R$ such that the rectified signal $S_R$ has an appropriate level to generate the first signal $S_1$, and the second signal $S_2$ may be generated from the level-controlled first signal $S_1$. Alternatively, the driving signal $S_D$ may be generated from the level-unadjusted first signal $S_1$ and the second signal $S_2$, and then, the signal level control unit 230 for controlling the level of the driving signal $S_D$ may be disposed at a front stage of the light emitting unit 260, thus solving the foregoing defects.

The operation unit 250 applies the driving signal $S_D$ to the light emitting unit 260 including one or more LEDs (S43). The operation unit 250 may apply the driving signal $S_D$ to the light emitting unit 260 through a circuit such as a voltage follower. As described above, the driving signal $S_D$ is a DC type signal generated by adding a plurality of AC type signals and may include a ripple component to an extent even after entering a stable state. However, since the ripple component included in the driving signal $S_D$ is very small, a smoothing electrolytic capacitor disposed between the output terminal of the operation unit 250 and the light emitting unit 260 may be omitted or may be substituted by a capacitor having a very small capacitance. Thus, a degradation of a lifespan of the LED caused as a capacitor having a relatively large capacitance is applied in order to remove a ripple component when the ripple component included in the driving signal $S_D$ is large, can be prevented.

As set forth above, according to embodiments of the invention, in using AC power source in an LED driving apparatus for driving one or more LEDs, AC signals, each having a different waveform, are arithmetically operated so as to be generated as an LED driving signal, thus substantially decreasing a ripple component and stably driving the LEDs.

Also, the LED driving apparatus driving one or more LEDs does not use a capacitor or uses a capacitor having a very small capacitance, thus preventing a lifespan of the LEDs from being shortened.

While the present invention has been shown and described in connection with the embodiments, it will be apparent to those skilled in the art that modifications and variations can be made without departing from the spirit and scope of the invention as defined by the appended claims.

What is claimed is:

1. An LED driving apparatus comprising:

a rectifying unit rectifying an input signal to generate a first signal;

a signal conversion unit inverting the first signal to generate a second signal; and an operation unit adding the first and second signals to generate a smoothed driving signal.

2. The apparatus of claim 1, further comprising:

a signal level control unit controlling the level of the first signal and transferring the controlled first signal to at least one of the signal conversion unit and the operation unit.

3. The apparatus of claim 2, wherein the signal level control unit includes a transformer controlling the level of the first signal.

4. The apparatus of claim 1, further comprising:

a smoothing circuit unit substantially reducing a ripple component included in the driving signal.

5. The apparatus of claim 4, wherein the smoothing circuit unit includes a multi-layer ceramic capacitor (MLCC).

6. The apparatus of claim 1, wherein the signal conversion unit inverts the first signal on the basis of an intermediate value of the first signal corresponding to half of a level peak value of the first signal to generate the second signal.

7. A method for driving an LED, the method comprising:

rectifying an input signal to generate a first signal;

inverting the first signal to generate a second signal; and adding the first and second signals to generate a smoothed driving signal.

8. The method of claim 7, further comprising:

removing a ripple component included in the driving signal.

9. The method of claim 7, wherein the generating of the second signal includes inverting the first signal on the basis of an intermediate value of the first signal corresponding to half of a level peak value of the first signal to generate the second signal.

* * * * *